United States Patent [19]

Takisawa et al.

[11] 4,168,185

[45] Sep. 18, 1979

[54] PRODUCTION METHOD OF TITANIUM HOT COIL BY CONTINUOUS HOT ROLLING SYSTEM

[75] Inventors: Kensaburo Takisawa, Kobe; Kenta Yoshii, Kakogawa; Takashi Nishimura; Yuuji Koyama, both of Kobe, all of Japan

[73] Assignee: Kobe Steel, Ltd., Kobe, Japan

[21] Appl. No.: 880,844

[22] Filed: Feb. 23, 1978

[30] Foreign Application Priority Data

Feb. 25, 1977 [JP] Japan ..... 52/20529
Feb. 25, 1977 [JP] Japan ..... 52/20530

[51] Int. Cl.[2] ..... C22F 1/18

[52] U.S. Cl. ..... 148/11.5 F; 72/227; 148/12.7 B

[58] Field of Search ..... 148/11.5 F, 12.7 B; 72/227

[56] References Cited

U.S. PATENT DOCUMENTS

| | | | |
|---|---|---|---|
| 3,169,085 | 2/1965 | Newman | 148/11.5 F |
| 3,481,799 | 12/1969 | Day et al. | 148/11.5 F |
| 3,492,172 | 1/1970 | Sauvageot et al. | 148/11.5 F |
| 3,496,755 | 2/1970 | Guernsey et al. | 148/11.5 F |

*Primary Examiner*—W. Stallard

*Attorney, Agent, or Firm*—Oblon, Fisher, Spivak, McClelland & Maier

[57] ABSTRACT

In producing a titanium strip using a continuous hot strip mill, the invention discloses a method of producing a titanium hot coil by a continuous hot rolling system characterized by the steps of heating a titanium slab to 700°-950° C. inside a heating furnace, then performing the hot rolling, and winding the hot rolled strip in a coil form while the strip is kept at a temperature of not lower than 450° C. under a condition that at the time of taking up the leading portion of the resulting titanium hot rolled strip after hot rolling, its trailing portion is being caught by the final stand roll of a finishing mill of the continuous hot strip mill.

5 Claims, No Drawings

PRODUCTION METHOD OF TITANIUM HOT COIL BY CONTINUOUS HOT ROLLING SYSTEM

BACKGROUND OF THE INVENTION (1) Field of the Art

The invention relates to a method of producing a titanium hot coil, especially to a method of obtaining a titanium hot coil having excellent surface quality by continuously producing a high quality titanium hot rolled strip of a varying thickness using a continuous hot strip mill and tightly taking up the resulting hot rolled strip in a coil form without causing those problems such as large telescopic coiling, friction dig, etc. which would otherwise occur frequently during the winding operation of the rolled strip immediately after rolling.

(2) Description of the Prior Art

A titanium material has excellent chemical and mechanical properties such as good corrosion resistance, heat resistance and abrasion resistance, and high specific strength. Owing to these outstanding properties, the titanium material has gained in recent years a wide range of application as an excellent material for airplanes, heat exchangers, apparatuses for converting brine into fresh water, electric power plants, apparatuses for the chemical industry and so forth. The demand for this material will be further increasing in the future.

At present, however, the production of the titanium strip has been carried out on a limited scale mainly using a Steckel mill. The Steckel mill consists of two sets of coilers and a 4-High reversible rolling mill interposed between the coilers whereby the titanium slab is passed through the 4-High reversible rolling mill, alternately taken up by the two coilers and caused to reciprocate in a required number of reciprocation so as to gradually reduce its thickness and thus to obtain a titanium strip having a desired thickness.

However, this method involves the problems that not only the mass-production is infeasible, but also the dimensional accuracy of thickness is low. In addition, the method is not free from the problems such as inferior shape of the camber and frequent occurrence of surface defects due to the scale.

It is therefore an earnest desire for those concerned in the art to develop a novel mass-production system which would replace the abovementioned Steckel mill system and enable to produce high quality titanium strip on a large scale at a low production cost in high yield. Most desirable and advantageous mass-production system would be one which uses a continuous hot rolling system and to which a hot strip mill for steel is adaptable.

Unlike the steel, however, titanium is extremely reactive, has a small specific gravity and its stress-strain characteristics is extremely sensitive to a temperature change. Because of these properties, the continuous hot rolling process of the titanium strip over its entire production steps ranging from heating, rolling and winding involves wide and difficult technical problems that are remarkably different from those encountered in rolling of the steel as will be described elsewhere in this specification. For this reason, the industrial production of the titanium strip has not yet been established in accordance with the continuous hot rolling system.

In comparison with the steel, the production of the titanium strip by the hot rolling is more difficult. Especially, large telescopic coiling tends to occur during the take-up operation of the strip after rolling, and it is not easy to obtain a normal coil tightly wound in an orderly manner. This is a phenomenon peculiar to the winding of the titanium strip that cannot be observed in the winding of the steel strip.

Occurrence of this large telescopic coiling not only constitutes a serious obstacle in performing a series of the entire production steps of the continuous hot rolling, but also means the production of an inferior product as such. Even if the degree of large telescopic coiling is not much serious, it induces mutual contact of the surface of strip during winding whereby so-called "friction dig" (8) of a recessed form take place over the wide range on the surface of the strip (6) and extremely deteriorate the surface quality of the coil. At times, a produced coil becomes defective as a whole lot.

Incidentally, as the prior art most relevant to the present invention, mention can be made of U.S. Pat. Nos. 3,169,085, 3,496,755, 3,492,172 and 3,481,799.

SUMMARY OF THE INVENTION

The present invention is completed in order to solve the aforementioned problems inherent to titanium and to rationally solve the problems of the conventional production method of a titanium hot rolled strip.

It is an object of the present invention to provide a production method of a titanium hot coil in accordance with the continuous hot rolling system by setting the temperature of a slab to a specific temperature range during the heating stage of the slab inside a heating furnace up to the winding stage of the resulting hot rolled strip in order to ensure the smooth operation and secure stable quality.

It is another object of the present invention to provide a production method of a titanium hot coil which solves the technical problems involved in the take-up operation of the titanium strip and enables to carry out the smooth winding of the strip without causing large telescopic coiling and surface scratches and to secure good surface quality.

In order to accomplish the abovementioned objects, the first embodiment of the invention is a production method of a titanium hot coil in accordance with the continuous hot rolling system which comprises heating a titanium slab to 700°-950° C. inside a heating furnace, hot rolling it using a continuous hot strip mill, and, winding the hot rolled strip in a form of coil while the strip is kept at a temperature of at least 450° C. under a condition that at the time of winding the leading portion of the titanium hot rolled strip during the take-up after hot rolling, the trailing portion thereof is caught by the final stand roll of a finishing mill of the continuous hot strip mill.

In performing the first embodiment, the second embodiment of the invention includes the step of heating the titanium slab preferably to 800°-920° C. inside the heating furnace.

In performing the first embodiment, the third embodiment of the invention includes the step of effecting the finishing rolling of the titanium slab in the continuous hot strip mill preferably at 650°-800° C.

In performing the first embodiment, the fourth embodiment of the invention includes the step of taking up the titanium hot rolled strip in a coil form preferably at a temperature range of from 500° to 750° C.

In performing the first embodiment, the fifth embodiment of the invention employs the titanium slab having a weight of at least a value M which is obtained from the following equation.

$$M = A \cdot t \cdot \omega \cdot \delta$$

where

A is a sum of the distance from the core of the final stand of a finishing mill to the core of the pinch roll of a coiler and the distance from the core of the pinch roll to one turn of the resulting strip around a mandrel (mm);

t is a thickness of the strip (mm);

$\omega$ is a width of the strip (mm);

$\delta$ is a density of titanium (ton/mm$^3$); and

M is a weight of the titanium slab (ton).

DETAILED DESCRIPTION OF THE PREFERRED EMBODIMENTS

By stipulating the temperature of a rolling material during the production process of a titanium hot coil, especially the heating temperature of the slab prior to the rolling, to the range of about 700°–950° C., the present invention enables the smooth heating operation, provides a suitable temperature of the material to the subsequent steps of roughing rolling and finishing rolling and secures the stable rolling operation free from miss-rolling and the like.

By further stipulating the take-up temperature to at least about 450° C., the present invention prevents occurrence of large telescopic coiling and friction dig, and enables to obtain a normal coil having good surface quality.

In producing a titanium strip by continuous hot rolling, the present invention uses for hot rolling a slab having such a weight that provides the resulting strip with a length longer than the entire length of the run-out table (i.e., distance between the final finish roll stand and the take-up roll) and at the time of winding the leading portion of the resulting strip after hot rolling, the invention winds it while the trailing portion is being caught by the final stand roll of finishing mill, thereby similarly enabling to prevent large telescopic coiling and to obtain a normal coil without surface scratches.

Next, the present invention will be explained in further detail.

According to the method of the present invention, it is possible to continuously produce a strip of an optional thickness ranging from about 1.2 to 6 mm or more using a slab of a varying dimension through a series of hot rolling operations ranging from a heating furnace, roughing mill, finishing mill up to a coiler. Incidentally, the term "titanium material" herein used is a generic term of a so-called commercially pure titanium which includes those stipulated by various Japanese Industrial Standards (JIS).

There is no specific limitation to the dimension of a slab to be used in the method of the present invention and an optional dimension may therefore be selected in accordance with various production conditions such as the ingot weight determined by melting and casting conditions, the specifications of a heating furnace and rolling mills in the hot rolling installation, and so forth. It is possible to use, for example, a slab having a thickness of about 50–150 mm, a width of about 500–2100 mm and a length of about 4–12 m. It is preferred to use a slab having a relatively large thickness when the heating furnace has such a construction that tends to cause deformation of the slab due to the mode of placing the slab over the beam inside the furnace or the mode of conveying the same thereinside. In the case of the heating furnace of a walking beam system, for example, the end portion of the slab tends to hang down by its own gravity if the length of the slab outwardly extending from the beam is long, thereby preventing the smooth transfer of the slab inside the furnace. In such a case, it is possible to restrain the quantity of deformation to such an extent as not to hinder the smooth operation by setting the heating temperature of the slab to a proper level (as will be described in detail) as well as by using a slab of a relatively large thickness, preferably about 80 mm or more.

The temperature of the material at each production step must be retained within a predetermined preferable range suited for the respective step in order to smoothly perform the operation and to secure stable quality of the product after the slab is withdrawn from the heating furnace and subsequently taken up as a coil through a series of production steps such as through the roughing mill and finishing mill.

In the continuous hot rolling system which is not furnished with means for controlling the material temperature after the slab is withdrawn from the heating furnace, the temperature of the material after withdrawal is substantially determined by the slab temperature at the time when it is withdrawn from the heating furnace. Setting of the heating condition of the slab inside the heating furnace, especially setting of the heating temperature of the slab, is therefore of utmost importance.

If the slab temperature becomes excessively high inside the heating furnace, the slab causes softening and deformation (especially hang-down due to its own gravity at portions where the slab is not supported by skid rails) whereby conveying of the slab inside the furnace and withdrawal of the slab become extremely difficult or impossible. In addition, oxidation damage and loss of the titanium surface become remarkable. Especially when the slab temperature remarkably exceeds the $\beta$ transformation point (about 880°–890° C.), the oxidation speed is accelerated and an occurring quantity of the primary scale is increased, thereby lowering the yield. Moreover, the scale thus formed can hardly be removed, remains as it is and forms scale scratches as it is pushed into the surface of the material during rolling.

Since titanium has large hydrogen-absorbing property, it involves the risk of absorbing the hydrogen separated from the cooling water for the rolls during rolling and causing deterioration of machanical properties of the product. This problem becomes especially remarkable in the temperature range exceeding the $\beta$ transformation point.

If the take-up temperature is high during winding of the strip, the surface of the strip mutually cause friction that results in so-called "friction dig."

In order to prevent these problems occurring at the respective production steps, the upper limit must be stipulated to the temperature in accordance with the content of operation of each step. This requirement can be satisfied by stipulating the upper limit of the withdrawing temperature of the slab to about 950° C., preferably about 920° C.

If the heating temperature is too low, on the other hand, the accuracy of shape and size of the rolled product becomes inferior and problems such as up-bending and down-bending at the leading and trailing portions of the material, camber, pinching, etc., tend to occur as well which directly lead to mis-rolling during roughing and finishing rolling.

In case the take-up temperature of the strip after rolling is too low, the normal winding operation becomes difficult as will be later explained whereby fatal defects such as large telescopic coiling, friction dig, etc., frequently occur.

The problems arising from the low material temperature can be prevented by ensuring a temperature exceeding a predetermined lower limit inside the heating furnace. Such a lower limit is about 700° C., preferably about 800° C.

By controlling the heating temperature of the slab inside the heating furnace in the range of from about 700° to 950° C., preferably from 800° to 920° C. for the above-mentioned reasons, it is possible to guarantee a suitable temperature for the operation inside the heating furnace and for each of the subsequent production steps after the withdrawal of the slab from the heating furnace. Incidentally, rapid heating is preferred within such a range that does not cause non-uniform heating, in order to minimize the occurrence of scale loss inside the heating furnace.

After withdrawn from the heating furnace, the slab is finally transferred to the take-up stage of the resulting strip through the steps of roughing rolling and finishing rolling.

Since titanium is highly reactive, friction dig tends to take place because of the mutual friction of the titanium surface. If the take-up temperature is not proper, furthermore, tight winding becomes impossible and the coil obtained thereby is a telescopically wound coil and a defective product. The aforementioned heating temperature is stipulated in order to prevent these problems. However, a further restricted take-up temperature is desired in order to secure the tight winding especially because the yield stress, yield strain, etc. of titanium remarkably change even by a slight change in the temperature, so that the normal winding operation is prevented thereby.

If the temperature is lower than about 450° C., further, the yield stress and the yield strain of titanium become remarkably greater in comparison with those of the mild steel, thereby increasing an amount of spring-back which hinders the tight winding operation. In order to maintain the yield stress, etc. of, titanium to substantially the same level as the mild steel, therefore, the temperature must be retained at not lower than about 450° C., preferably not lower than about 500° C. However, the occurrence of friction dig increases with an increasing activity of titanium at a higher temperature. For this reason, the upper limit is preferably about 750° C.

In addition to the aforementioned restriction of the heating temperature of the slab, therefore, the take-up temperature of the strip is restricted to about 450° C. or more, preferably from about 500 to about 750° C. This temperature range stabilizes the winding operation of the strip, ensures the normal winding operation and provides a coil having good surface quality.

There is no specific limitation to the hot rolling condition from roughing rolling to the completion of finishing rolling after withdrawal of the slab from the heating furnace. Namely, the operation may be carried out using an ordinary continuous hot rolling mill in accordance with the temperature condition which is automatically determined by the setting of the above-mentioned heating temperature and the take-up temperature.

Namely, the slab heated to the predetermined temperature inside the heating furnace is passed through means for removing the surface scales such as descaling shot or double pinch rolls, if necessary, and then transferred to a roughing mill.

The roughing mill generally consists of several stands and may be of a reverse type, a combination of a back-pass type with a reverse type, or a continuous type. The rough bar roll-reduced to a predetermined thickness by the roughing mill is transferred to a finishing mill.

The finishing mill may be of an ordinary type consisting of several stands. In the finishing mill, the rough bar is sequentially roll-reduced till a strip of a desired thickness is obtained. The strip so formed is then transferred to a coiler.

The coiler may be of an ordinary type such as a unit roll type or blocker-roll type down-coiler and the like.

Since the withdrawing temperature of the slab from the heating furnace is restricted as previously mentioned, the material in the above-mentioned roughing rolling and finishing rolling is provided with a temperature falling within a predetermined preferable range, thereby preventing in advance the aforementioned various troubles. In performing the temperature control at these production steps, it is recommended that the target control temperature for the finishing rolling be in the range of from about 650° to about 800° C. If the material used is thin or when the temperature drop during rolling is abnormally large for one reason or other, it is a simple and relatively effective measure to throttle the quantity of the cooling water for the rolls in order to restrain the temperature drop. On the contrary, when the temperature drop is small because the material is thick and the discharge temperature of the strip from the finishing mill is abnormally high so that the resulting strip is fed to the coiler at a temperature exceeding the upper limit of the take-up temperature, it is effective to interpose spray means of the cooling water between the finishing stand and the coiler.

Furthermore, the winding method of the titanium strip after the continuous hot rolling is of utmost importance in the present invention in view of the properties inherent to titanium.

In order for the strip to be smoothly wound, the winding force (pulling force) of the mandrel of the coiler must always be kept in equilibrium with the back-tension acting against the winding force. Unlike the titanium strip, the steel strip is provided with the necessary back-tension as explained below, has a sufficient buffer action against irregular changes in the tensile strength imparted thereto and thus always maintains a predetermined windability. It is assumed that when compared with the steel strip, the titanium strip has insufficient back-tension and yet a great amount of spring-back and consequently, it fails to absorb the change in the tensile strength imparted thereto.

In other words, the back-tension acting on the strip is given as a sum of its own inertia resistance and the frictional force between the strip and the run-out table. However, since the specific gravity of titanium (about 4.5) is extremely low in comparison with that of iron (about 8), both of the inertia resistance and the frictional force of titanium are low, and its back-tension is extremely lower than that of iron.

As can be clearly seen also from the aforementioned, the steel strip has a small amount of spring-back but sufficient back-tension so that good windability can be secured even when the trailing end of the strip has already left the final stand at the time when the leading end of the strip is wound onto the mandrel. In contrast to the steel strip, the titanium strip is transferred to the coiler under such condition where it has small back-tension and a large amount of spring-back. Consequently, when one turn of the leading end of the strip is brought into contact with the mandrel of the coiler that is rotating at a higher speed than the running speed of the strip on the run-out table, the strip speed is elevated, due to its insufficient back-tension as if it were "pulled" up, to the revolution speed of the mandrel rotating at a lead ratio exceeding the speed instruction value from the speed control system for the coiler and on the next instant, the back-tension becomes insufficient due to the reaction to the pulling action and the action of the amount of spring-back is simultaneously added whereby stability of winding is broken and the strip is taken up in the relaxed or disorderly state.

Fluctuation of this take-up stability can be observed from the mandrel current, the mandrel speed and the pinch roll speed. It can be appreciated that when the trailing end of the strip is caught by the rolling mill at the start ($t_o$) of winding the leading end, the mandrel current exhibits an abrupt increase which means the tight winding, and both of the mandrel speed and the pinch roll speed are stable, whereas when the trailing end is left free, tight winding is not effected, slipping occurs and the current rise is gradual. Due to slipping, the mandrel speed tends to increase, and the pinch roll speed also increases due to the insufficient back-tension.

Disorder of winding resulting from the irregular changes in the winding condition is apt to occur especially at the initial winding stage. If the first winding is unstable, the subsequent winding is unstable while good windability is not recovered. If the first single or several turns are normally wound, however, disturbance in winding does not occur even if irregular fluctuation subsequently occurs, and provides a coil that is tightly wound.

If the large telescopic coiling of the titanium strip arises from the insufficient back-tension and the large amount of spring-back and their effect remarkably appears especially at the initial stage at which the winding condition irregularly fluctuates, they can then be prevented by supplementing the insufficiency of the back-tension and applying a strong force so as to absorb the amount of spring-back at the initial stage of the winding operation.

As a method to accomplish the above-mentioned object, it is extremely effective, and practical, to take up the strip while its trailing end is being caught by the finishing stand roll at the initial winding stage. Under such a condition, the mandrel rotates at a leading ratio exceeding the traveling speed of the strip while the trailing end of the strip is yet restricted by the roll. In consequence, the strip is imparted with a strong tensile force in the direction opposite the advancing direction, thus the amount of spring-back of the titanium strip is sufficiently absorbed in itself and sufficient back-tension is provided therein.

In order to establish such a state where the trailing end of the strip is yet caught by the final stand roll of finishing mill at the initial winding stage, that is, after the leading end of the strip is wound onto the mandrel in one or several turns, it is necessary to use a titanium slab having such a weight that furnishes the resulting strip with a length longer than the distance between the mandrel and the stand (length of the run-out table).

The above-mentioned slab weight is determined by the length of the run-out table and the size (thickness and width) of the strip as a product to be produced in accordance with the following formula $$M \geqq A \cdot \omega \cdot t \cdot \delta$$

where

M is the weight of the titanium slab (ton);

A is a sum of the distance from the core of the final stand roll of the finishing mill to the core of the pinch roll of the coiler and the distance from the core of the pinch roll to one turn of the strip onto the mandrel (mm);

$\omega$ is the width of the strip (mm);

t is the thickness of the strip (mm); and $\delta$ is a density of titanium (ton/mm$^3$).

Though the above-mentioned formula does not include the decrease in weight due to the scale loss inside the heating furnace and the weight corresponding to one or several turns of the strip onto the mandrel, etc., they must naturally and properly be taken into account in accordance with the respective operation conditions.

As mentioned above, the present invention restricts the trailing end of the strip by the roll so as to cause a tensile force against the advancing direction of the strip and to impart sufficient back-tension to the strip. The same action can effectively be attained by various methods such as, for example, by disposing a pinch roll at the intermediate portion of the run-out table in order to apply a force against the advance of the strip. Such methods are employed especially when the slab weight is restricted on account of the installation used and the like.

The above-mentioned continuous hot rolling of titanium by the use of a hot strip mill involves various those problems not only at the take-up stage but also at the heating and rolling stages, which are not encountered with the hot rolling of the steel. As explained in the foregoing paragraph, these problems arise from the fact that titanium itself has high activity and its mechanical properties such as the yield strength, etc., are by far sensitive to the temperature. In order to eliminate the problems of the rolling operation and of the quality of the product resulting from the peculiar properties of titanium and smoothly perform the rolling operation, the temperature control must be made especially carefully. Hence, the heating of the slab is preferably effected at about 700°–950° C. and the finishing rolling at about 650°–800° C. In addition, the take-up temperature of about 450° C. or more ensures especially good winding.

The present invention will further be illustrated with reference to the following examples.

EXAMPLE 1

A titanium hot rolled strip is produced using a continuous hot strip mill for hot rolling a steel strip under the following conditions.

A slab of commercially pure titanium (thickness=120 mm width=764 mm, length=9,904 mm; Ti=about 99.5%) is heated by a walking beam type heating furnace, withdrawn at 910° C., passed through a roughing mill to obtain a rough bar having a width of 775 mm and a thickness of 30 mm, then passed through a finishing mill to obtain a strip having a thickness of 3.0 mm and a width of 782 mm and finally transferred to a coiler to produce a coil.

The discharging temperature of the roughing mill is 790° C. and the discharging temperature of the finishing mill is 670° C. The take-up is effected at a temperature range of from 470° to 490° C.

Heating, roughing, finishing rolling and winding all are carried out smoothly to provide a tightly wound coil without large telescopic coiling.

The resulting coil has good accuracy in its dimension and shape, is perfectly free from friction dig and exhibits good surface quality with extremely few scale scratches.

As a result of the tensile test after cold-rolling and annealing, the coil is found to have a tensile strength of about 30–34 kg/mm$^2$ and elongation of about 40–46%. It is thus confirmed that the coil has no problem at all with respect to its mechanical properties.

EXAMPLE 2

A 4.1-ton slab of commercially pure titanium (Ti=99.5%) is rolled by a continuous hot strip mill to obtain a strip of a thickness of 3.2 mm and a width of 800 mm and taken up by a 3-unit roll type down coiler (take-up temperature=470° C.) under the following conditions to obtain a coil (product standard=KS40). Incidentally, the sum of the distance from the core of the final stand of the finishing mill to the core of the pinch roll of the coiler and the distance from the core of the pinch roll to one turn of the strip onto the mandrel is 194 m in this apparatus.

(A) Conditions set for the take-up roll:

| | | |
|---|---|---|
| (a) | Pinch roll gap: | thickness × 0.90 |
| (b) | Unit roll gap: | thickness × 1.20 |
| (c) | Run-out table speed: | Speed of stand of finishing mill (hereinafter referred to as "$S_{FS}$") × 1.18 |
| (d) | Pinch roll speed: | $S_{FS}$ × 1.05 |
| (e) | Unit roll speed: | $S_{FS}$ × 1.25 |
| (f) | Mandrel speed: | $S_{FS}$ × 1.25 |
| (g) | Set value of a mandrel current: | 1700 Amp. |

(B) Windability and Coil Properties of Product:

The length of the strip rolled from the slab is about 350 m. At the initial take-up stage, the strip is taken up while its trailing end is being caught by the final roll, and a tightly wound normal coil is obtained with good windability. The surface of the coil has no friction dig and exhibits good quality.

As explained in the foregoing paragraph, the present invention establishes a production method of a titanium hot coil by a continuous hot rolling system, smoothly carries out the winding operation of the titanium strip which would otherwise be apt to cause large telescopic coiling, and thus enables to obtain a good coil. In accordance with the present invention, it is possible to stabilize a series of operation steps of the continuous hot rolling, to maintain a production yield at a high level and to ensure excellent dimension and surface quality of the coil as a product.

What is claimed is:

1. A production method of a titanium hot coil by a continuous hot rolling system which comprises; heating a titanium slab to 700°–950° C. inside a heating furnace; hot rolling the slab by a continuous hot strip mill; and winding the hot rolled strip in a coil form while the strip is kept at a temperature of not lower than 450° C. under a condition that at the time of winding the leading end of the resulting hot rolled strip, its trailing end is being caught by the final stand roll, of a finishing mill of said continuous hot strip mill.

2. The production method of a titanium hot coil as defined in claim 1 wherein said titanium slab is heated preferably to 800°–920° C. inside a heating furnace.

3. The production method of a titanium hot coil as defined in claim 1 wherein finishing rolling of said titanium slab in the continuous hot strip mill is effected at 650°–800° C.

4. The production method of a titanium hot coil as defined in claim 1 wherein said titanium hot rolled strip is preferably wound in a coil form at a temperature range of from 500°–750° C.

5. The production method of a titanium hot coil as defined in claim 1 wherein said titanium slab has a weight not smaller than a value M obtained from the following formula $$M = A \cdot t \cdot \omega \cdot \delta$$

where

A is a sum of the distance from the core of the final stand of the finishing mill to the core of a pinch roll of the coiler and the distance from the core of the pinch roll to one turn of the strip onto the mandre (mm);

t is a thickness of the strip (mm);

$\omega$ is a width of the strip (mm);

$\delta$ is a density of titanium (ton/mm$^3$); and

M is a weight of the titanium slab (ton).

* * * * *